US009415843B1

(12) United States Patent
Vandenworm

(10) Patent No.: US 9,415,843 B1
(45) Date of Patent: Aug. 16, 2016

(54) FLOATING DRILLER

(71) Applicant: JURONG SHIPYARD PTE LTD., Singapore (SG)

(72) Inventor: Nicolaas Johannes Vandenworm, Houston, TX (US)

(73) Assignee: JURONG SHIPYARD PTE LTD., Singapore (SG)

( * ) Notice: Subject to any disclaimer, the term of this patent is extended or adjusted under 35 U.S.C. 154(b) by 0 days.

(21) Appl. No.: 14/926,085

(22) Filed: Oct. 29, 2015

Related U.S. Application Data

(63) Continuation-in-part of application No. 14/452,826, filed on Aug. 6, 2014, now Pat. No. 9,227,703.

(60) Provisional application No. 61/872,515, filed on Aug. 30, 2013.

(51) Int. Cl.

| | |
|---|---|
| ***B63B 35/44*** | (2006.01) |
| ***B63B 3/14*** | (2006.01) |
| ***B63B 39/03*** | (2006.01) |
| ***B63B 3/48*** | (2006.01) |
| ***B63B 3/38*** | (2006.01) |

(52) U.S. Cl.

CPC ..... *B63B 35/4413* (2013.01); *B63B 3/14* (2013.01); *B63B 3/38* (2013.01); *B63B 3/48* (2013.01); *B63B 39/03* (2013.01); *B63B 2003/147* (2013.01); *B63B 2003/385* (2013.01); *B63B 2035/448* (2013.01); *B63B 2035/4473* (2013.01)

(58) Field of Classification Search

CPC ..... B63B 35/44; B63B 35/4413; B63B 3/14; B63B 1/04; B63B 39/08; B63B 1/041; B63B 35/08; B63C 7/00

USPC ..... 114/49, 121, 264, 265

See application file for complete search history.

(56) References Cited

U.S. PATENT DOCUMENTS

| | | | | |
|---|---|---|---|---|
| 1,334,445 | A | | 3/1920 | Gaffney |
| 2,156,635 | A | | 5/1939 | Mascuch et al. |
| 3,041,639 | A | | 7/1962 | Atlas |
| 4,048,943 | A | * | 9/1977 | Gerwick, Jr. ..... B63B 35/08 114/256 |
| 4,281,615 | A | | 8/1981 | Wilson et al. |
| 4,282,822 | A | | 8/1981 | Jackson |
| 4,446,808 | A | | 5/1984 | Colin |
| 4,549,835 | A | | 10/1985 | Ando et al. |
| 4,640,214 | A | | 2/1987 | Bruns |
| 4,679,517 | A | | 7/1987 | Kramer |
| 4,984,935 | A | | 1/1991 | de Oliveira Filho et al. |
| 5,573,353 | A | | 11/1996 | Recalde |
| 6,524,050 | B1 | | 2/2003 | Arntezen et al. |
| 7,958,835 | B2 | | 6/2011 | Srinivasan |
| 8,251,003 | B2 | | 8/2012 | Vandenworm |
| 8,662,000 | B2 | | 3/2014 | Vandenworm |
| 8,869,727 | B1 | | 10/2014 | Vandenworm |
| 2007/0051294 | A1 | | 3/2007 | Pike |
| 2012/0132122 | A1 | | 5/2012 | Vandenworm |
| 2012/0192782 | A1 | | 8/2012 | Eide |
| 2013/0133563 | A1 | | 5/2013 | Kroecker |

* cited by examiner

*Primary Examiner* — Lars A Olson

(74) *Attorney, Agent, or Firm* — Buskop Law Group, PC; Wendy Buskop

(57) ABSTRACT

A buoyant structure or floating driller having a hull, a planar keel, a lower frustoconical portion disposed above the planar keel with an inwardly sloping wall and an upper frustoconical portion connected to the lower frustoconical portion with an outwardly sloping wall forming a hull neck. The buoyant structure has a main deck and a moon pool, at least one external tank and a plurality of ballast compartments. The buoyant structure defines a low center of gravity, wherein the combination of the upper frustoconical portion and the lower frustoconical portion provide an inherent stability to the buoyant structure.

11 Claims, 4 Drawing Sheets

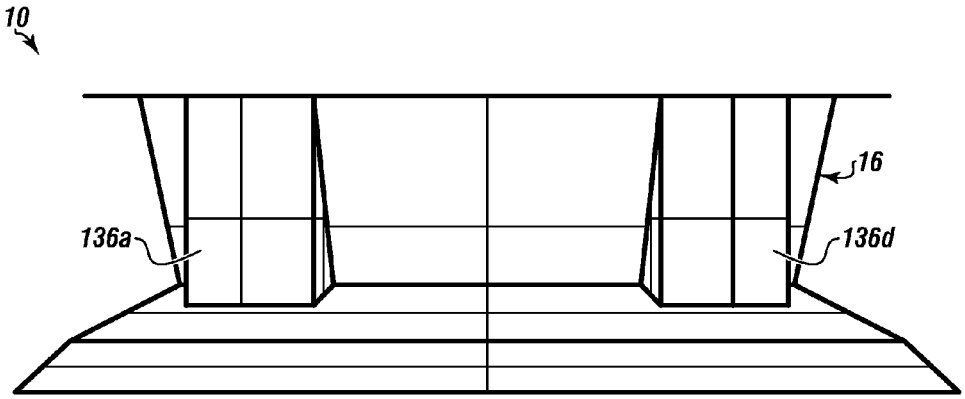
FIGURE 5
FIGURE 6
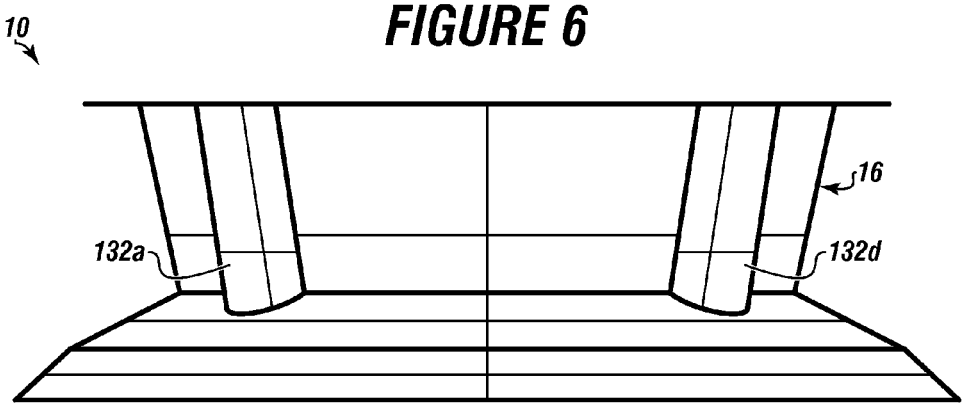
FIGURE 7
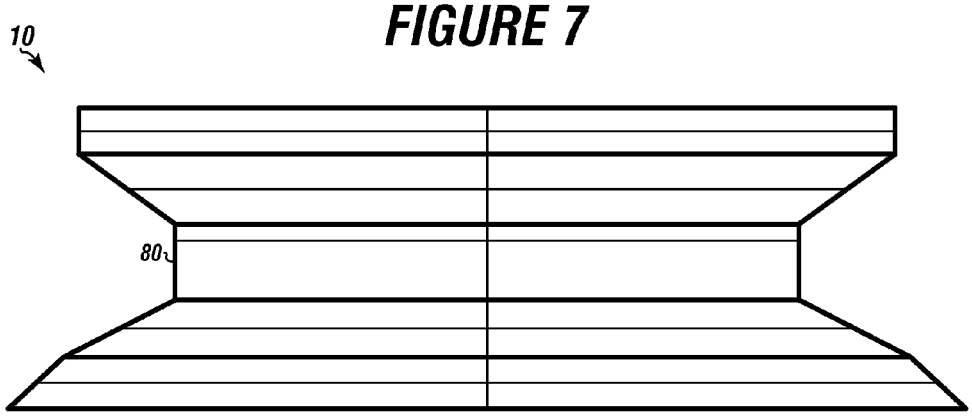

FLOATING DRILLER

CROSS REFERENCE TO RELATED APPLICATIONS

The present application is a continuation in part and claims priority to co-pending U.S. patent application Ser. No. 14/452,826 filed on Aug. 6, 2014, which claims priority to U.S. Provisional Application Ser. No. 61/872,515 filed on Aug. 30, 2013, both entitled "BUOYANT STRUCTURE FOR PETROLEUM DRILLING, PRODUCTION, STORAGE AND OFFLOADING,". These references are hereby incorporated in their entirety.

FIELD

The present embodiments generally relate to an offshore buoyant vessel used for petroleum drilling, floating production, storage and offloading.

BACKGROUND

A need exists for a drilling vessel that does not easily list.

A need exists for highly stable buoyant structure, such as a floating vessel that can be towed from drilling location to drilling location at sea or can move on its own power, and can additionally provide storage for tubulars in chambers, preventing tubulars from rolling off into the sea.

A need exists for a buoyant structure that provides an inherent stability to the buoyant structure by providing viscous damping that is both linear and quadratic damping resulting in minimum excitations of the buoyant structure in view of a global wave spectra.

A further need exists for larger moon pool in a drilling vessel to provide safer drilling operations for handling of equipment and personnel and to provide a larger contained space for making up tubulars and performing topsides subsea drilling activity.

The present embodiments meet these needs.

BRIEF DESCRIPTION OF THE DRAWINGS

The detailed description will be better understood in conjunction with the accompanying drawings as follows:

FIG. 5 depicts the buoyant structure with a plurality of columns according to one or more embodiments.

FIG. 6 depicts the buoyant structure with a plurality of blister tanks according to one or more embodiments.

FIG. 7 depicts the buoyant structure with a neck according to one or more embodiments.

Figure 1:
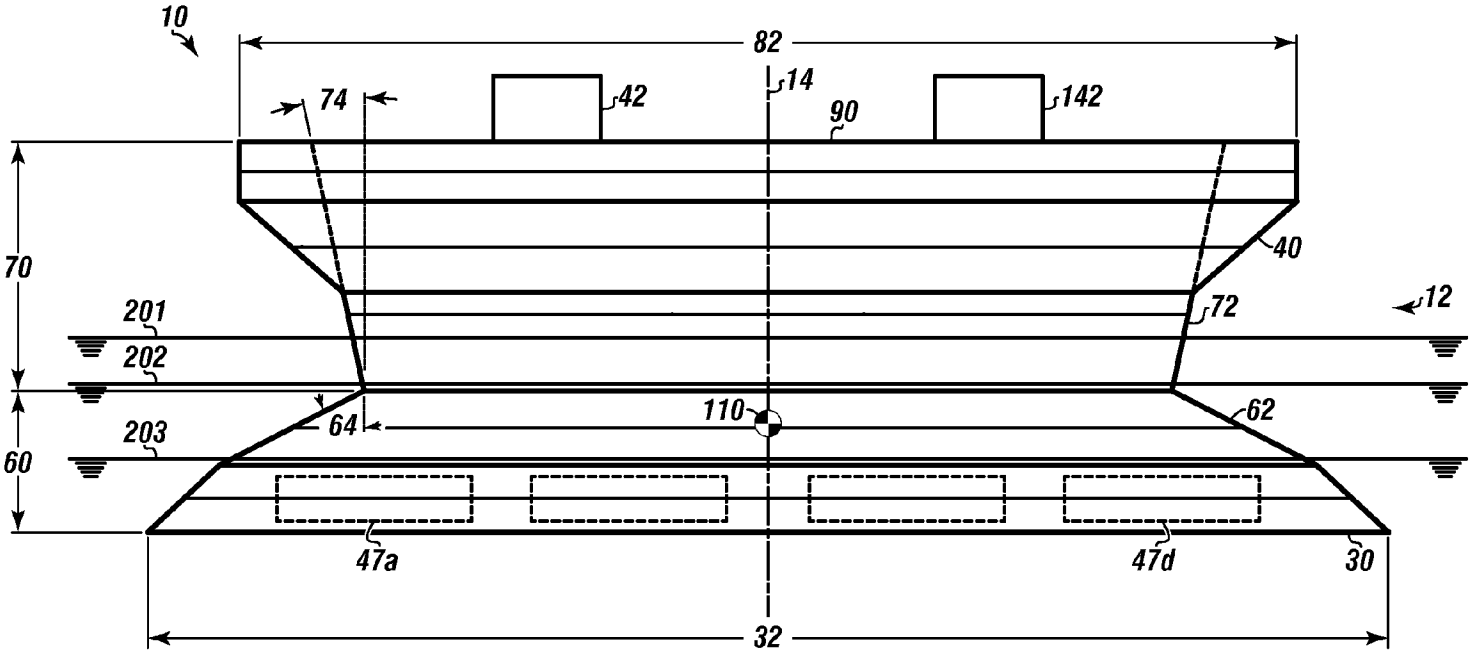
FIG. 1 depicts the buoyant structure in with three different usable drafts according to one or more embodiments.

The present embodiments are detailed below with reference to the listed Figures.

DETAILED DESCRIPTION OF THE EMBODIMENTS

Before explaining the present apparatus in detail, it is to be understood that the apparatus is not limited to the particular embodiments and that it can be practiced or carried out in various ways.

The present embodiments relate to a floating driller, such as an offshore buoyant vessel used for petroleum drilling, floating production, storage and offloading with several alternative hull designs.

The buoyant structure, using the combination of abutting upper and lower frustoconical portions provides an inherent stability to the buoyant structure by providing viscous damping that is both linear and quadratic damping resulting in minimum excitations of the buoyant structure in view of a global wave spectra.

The embodiments further relate to a floating vessel configured to support at least one of: drilling of wells, workover of wells, production of hydrocarbons, and personnel accommodation.

In embodiments, the buoyant structure can have a hull, a planar keel defining a lower hull diameter, a lower truncated cone portion disposed above the planar keel with an inwardly sloping wall at a first angle, an upper truncated cone portion directly connected to the lower truncated cone portion, and the upper truncated cone portion with an outwardly sloping wall.

In embodiments, the floating vessel can have a hull planform that is circular, oval, elliptical, or polygonal.

In embodiments, the floating vessel can have a main deck that can be concentric or polygonal. The main deck can be partially formed between an outer hull side and an inner hull side.

In embodiments, the inwardly sloping wall can abut the outwardly sloping wall forming a hull neck with a hull neck diameter.

The buoyant structure can have a main deck, a moon pool, and propellers attached to the planar keel, which can be operated by a motor or a generator.

The buoyant structure has the advantage for drilling personnel offshore by providing high stability at sea by providing reduced acceleration motion, which allows for emergency facilities within the buoyant structure, which can help in preventing injuries and death and can provide a safer working environment.

The buoyant structure can prevent explosions by providing segregated compartments, which buffer the impact of an explosion in one compartment, preventing "TITANIC®" like destruction. The buoyant structure provides a double hull on all quadrants that reduces the possibility of sinking upon impact with a structure, vessel, or natural object.

The buoyant structure can prevent fires by offering a main deck which can have self-contained emergency equipment, such as firefighting equipment. The buoyant structure can provide a main deck with reduced congestion from equipment residing on the main deck, which can enable personnel to reach fires that might break out to quickly isolate and extinguish those fires.

The buoyant structure can provide environmental protection by providing stable floating platform that will not easily fracture because the hull prevents excessive stresses due to the frustoconical shape of the hull and that a portion of the hull is below sea level. The buoyant structure with its enclosed moon pool reduces the pollution foot print that other buoyant structures with open moon pools might have.

The term "ballast compartments" as used herein can refer to water tight tanks configured to accept and reject sea water in a controlled manner to stabilizer the buoyant structure using computational vectors determined from the control center.

The term "buoyant structure" as used herein can refer to any floating vessel with a low center of gravity. In embodiments, the buoyant structure can have a unique structure of a combination of abutting upper and lower frustoconical portions. The buoyant structure can be a floating driller. The buoyant structure can provide an inherent stability to the buoyant structure by providing viscous damping that is both linear and quadratic damping resulting in minimum excitations of the buoyant structure in view of a global wave spectra.

The term "center of gravity" as used herein can refer to a center of mass of a rigid hull that is fixed in relation to the hull. In embodiments, the center of mass can be inside the hull of the buoyant structure. In embodiments, the center of mass can be outside the hull, such as at a position that is lower in the sea water than the planar keel or can extend horizontally away from the hull in a longitudinal or transverse direction.

The term "column" as used herein can refer to a chamber attached to the hull, which are not radially formed around the outer hull side of the buoyant structure. Each chamber can be formed in parallel with the vertical axis. In embodiments, the chamber can either be empty, a ballasting column or a cargo space.

The term "control center" as used herein can refer to a master processor located within the hull having a data storage with a plurality of non-transitory computer instructions in a computer readable medium and a display. The control center can additionally communicate to a network and can compute station keeping vectors and issues commands for station keeping devices. The control center can compute ballasting needs and issues commands to the external tanks to balance the hull. In embodiments, the control center can provide commands for seakeeping to a gyroscope system located in the hull. In embodiments, navigation and safety of the entire buoyant structure can be conducted by the control center.

The term "external tanks" as used herein can refer to tanks radially secured outboard of the hull. The radially formed external tanks can be void tanks or chain lockers which additionally can be used for ballasting and deballasting the hull. The external tanks can be used for wave deflection and reducing the formation of ice on the hull. In embodiments, the external tanks can be radially connected and can have a double wall structure which further adds protection to the hull.

The term "hull" as used herein can refer to the portion of the vessel from the planar keel to the main deck.

The term "hull neck" as used herein can refer to a transition between the upper and lower frustoconical sections that can be generally cylindrical and integral with both sections. The hull neck can have a diameter that ranges from 20 percent of a diameter of the main deck diameter to 150 percent of the diameter of the main deck.

The term "inner hull side" as used herein can refer to a continuous contour in parallel with an outer hull side. The inner hull side can be characterized by a shape selected from the group: circular, ellipsoid, and geodesic in horizontal cross-sections at all elevations. Octagonal shapes and other polygonal shapes can also be used as the shape of the inner hull side in multiple cross-sections.

The term "inwardly sloping wall" as used herein can refer to the outer hull side with a plurality of multiple cross-sections defined by at least one major and minor diameter, with respect to the vertical axis of the buoyant structure. The inwardly sloping wall can be a mirror image of the outwardly sloping wall. The inwardly sloping wall can be formed at an obtuse angle to the planar keel as measured from a point at which the vertical axis impacts the planar keel.

The term "linear damping and quadratic damping" as used herein can refer to linear contributions known as wave radiation and quadratic contributions known as drag load. The linear damping can be determined by diffraction-radiation calculations, quadratic heave, pitch and roll damping are easily tested motions by oscillation forces in the form of a decay test.

The term "low center of gravity" as used herein can refer to a center of gravity that is positive when compared to metacentric height of a buoyant vessel.

The term "lower frustoconical portion" as used herein can refer to a section of the hull connected to the planar keel which is totally submerged while in operational condition. The major diameter portion of the lower frustoconical section can integrally connect the planar keel. A minor diameter portion of the frustoconical section can adjoin the minor portion of an upper frustoconical section of the hull.

The term "main deck" as used herein can refer to a surface which can be used for staging drilling operations or hospital operations. The main deck can be integral with or mounted above the upper frustoconical section. In embodiments, the main deck can extend beyond the hull. In embodiments, the main deck can have a plurality of connected decks.

The term "minimum excitations given global wave spectra" as used herein can refer to the minimization of movement in water for a free floating body when that body is subjected to wind, wave and currents on a global scale that is accommodating information on the world's bodies of water. The wave spectra is defined using wave periods, wave heights, and wave directions from the various bodies of water on the planet.

The term "moon pool" as used herein can refer to an opening or protrusion in the main deck that extends through the hull and through the planar keel into the sea to allow for drilling operations or similar marine operations.

The term "outer hull side" as used herein can refer to the continuous contour with a plurality of angles.

The term "outwardly sloping wall" as used herein can refer to the outer hull side with a plurality of multiple cross-sections defined by at least one major and minor diameter with respect to the vertical axis of the buoyant structure. The outwardly sloping wall can be a mirror image of the inwardly sloping wall. The outwardly sloping wall can be formed at an acute angle to the planar keel as measured from a point at which the vertical axis impacts the planar keel.

The term "planar keel" as used herein can refer to the planar structure integrally connecting the bottom portion of the lower frustoconical portion and configured to support propellers, thrusters, fins, ribs, and propeller protection devices. Moorings, mooring leads, fairleads and cowcatchers can be installed on the planar keel. In embodiments, other station keeping devices can be installed on the planar keel.

The term "self-contained emergency equipment" as used herein can refer to emergency equipment and firefighting equipment that can be used during emergencies, such as to put out fires on the buoyant structure.

The term "station keeping devices" as used herein can refer to the communication devices with thrusters configured to dynamically position the buoyant structure relative to a fixed global positioning system location.

The term "substructure" as used herein can refer to structures located below the main deck, including but not limited to columns, blister tanks, or tendering arms. In embodiments, the substructure can extend laterally away from the hull, such as mooring arms, anchoring assists, or connections that allow fuel to be taken into the hull. The substructure can have one or more channels. In embodiments, the one or more channels can be formed through the hull. In embodiments, the one or more channels can have identical shapes to improve hull hydrodynamic performance through linear and quadratic damping using radiation effects and viscous effects.

The term "upper frustoconical portion" as used herein can refer to a section of the hull integrally connected to the lower frustoconical portion which is not totally submerged while in operational condition. The major diameter portion of the upper frustoconical section can integrally connect to the main deck of the buoyant structure.

The term "vertical axis" as used herein can refer to midship within the moon pool.

The term "viscous damping" as used herein can refer to damping, which can be caused by energy losses in liquid due to movement causing friction in the fluid forced. The viscous-damping, force is directly proportional to the relative velocity between the two ends of the damping structure.

Turning now to the Figures, FIG. 1 depicts the buoyant structure 10 in an operational position 201, a transit position 202 and a lightship position 203.

The buoyant structure 10 can be used for performing for at least one of: petroleum drilling, hydrocarbon production, hydrocarbon storage, and hydrocarbon offloading.

The buoyant structure 10 is shown having a hull 12 defining a vertical axis 14.

The buoyant structure 10 can have a main deck 90, which can support a control center 42 and self-contained emergency equipment 142, such as firefighting equipment.

The hull 12 is shown having a lower frustoconical portion 60 abutting an upper frustoconical portion 70.

The lower frustoconical portion 60 can be formed with an inwardly sloping wall 62, which can be formed at a first angle 64 to a plane of a planar keel 30.

The first angle 64 can range from 25 degrees to 85 degrees with respect to the plane of the planar keel 30.

The upper frustoconical portion 70 can be formed with an outwardly sloping wall 72, which can be formed at a second angle 74 with respect to the plane of the planar keel 30. The second angle 74 can range from 3 degrees to 85 degrees.

The inwardly sloping wall 62 of the lower frustoconical portion 60 can abut to the outwardly sloping wall 72 of the upper frustoconical section 70.

At least one external tank 40 can be radially secured outboard of the hull 12 and secured opposite the planar keel 30.

The external tank 40 can be in electronic communication with the control center 42 contained by the hull. The radially secured external tank 40 can have valves that communicate with the control center 42.

The buoyant structure 10 can have a plurality of ballast compartments 47*a*-47*d*. Each ballast compartment can be secured inboard of the hull 12 and mounted proximate the planar keel 30 in the lower frustoconical section 60.

The plurality of ballast compartments can be in communication with the control center 42 for ballasting and deballasting the hull 12 between the aforementioned operational position 201, transit position 202 and lightship position 203.

The plurality of ballast compartments 47*a*-47*d* can have valves that communicate with the control center 42.

In embodiments, the main deck 90 can have a concentric or polygonal shape and can be connected over the upper frustoconical portion 70.

The buoyant structure 10 defines a low center of gravity 110, wherein the combination of the upper and lower frustoconical portions provide an inherent stability to the buoyant structure by providing viscous damping that is both linear and quadratic damping resulting in minimum excitations of the buoyant structure in view of a global wave spectra.

The planar keel 30 is shown with a keel diameter 32. In embodiments, the keel diameter can extend from 50 meters to 150 meters.

The planar keel 30 can be integrally connected with the lower frustoconical portion 60 as a terminus of the outwardly sloping wall 62.

In embodiments, a main deck diameter 82 can be less that the keel diameter 32.

Figure 2:
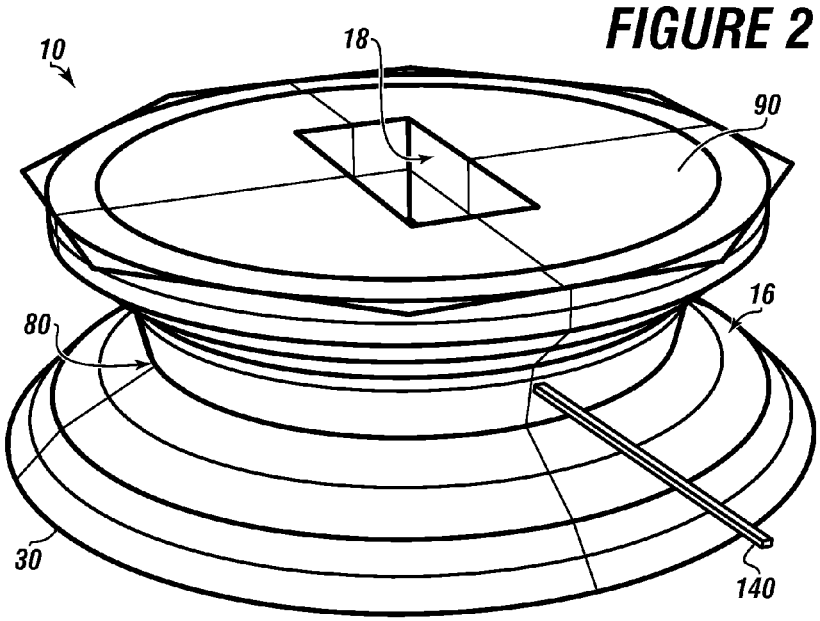
FIG. 2 depicts an isometric view of the buoyant structure having an inner hull side that connects with an outer hull side according to one or more embodiments.

FIG. 2 depicts an isometric view of the buoyant structure 10 having an inner hull side 18 that connects with an outer hull side 12 according to one or more embodiments.

The main deck 90 is depicted mounted over the upper frustoconical section. In embodiments, the main deck can be partially formed between the outer hull side 16 and the inner hull side 18.

At least one tendering arm 140 can be mounted between the main deck 90 and the planar keel 30. The at least one tendering arm can be completely attached to the outer hull side 16 or partially attached to the outer hull side 16.

A hull neck 80 can be connected integrally between the upper and lower frustoconical sections.

The planar keel 30 can be formed between the outer hull side 16 and the inner hull side 18.

Figure 3:
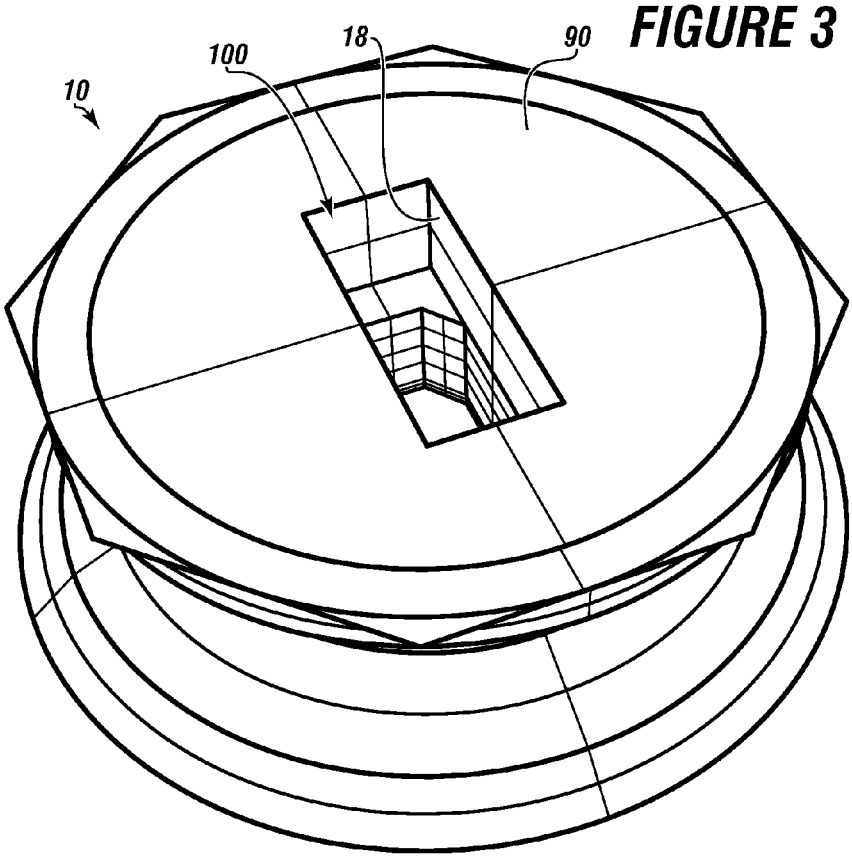
FIG. 3 depicts the buoyant structure with a moon pool according to one or more embodiments.

FIG. 3 depicts the buoyant structure 10 with a moon pool 100 formed within the inner hull side 18 according to one or more embodiments.

The moon pool 100 can be formed by the inner hull side 18 and can be characterized by at least one shape selected from the group: circular, polygonal, quadrilateral, ellipsoid, and geodesic.

The main deck 90 is also shown.

Figure 4:
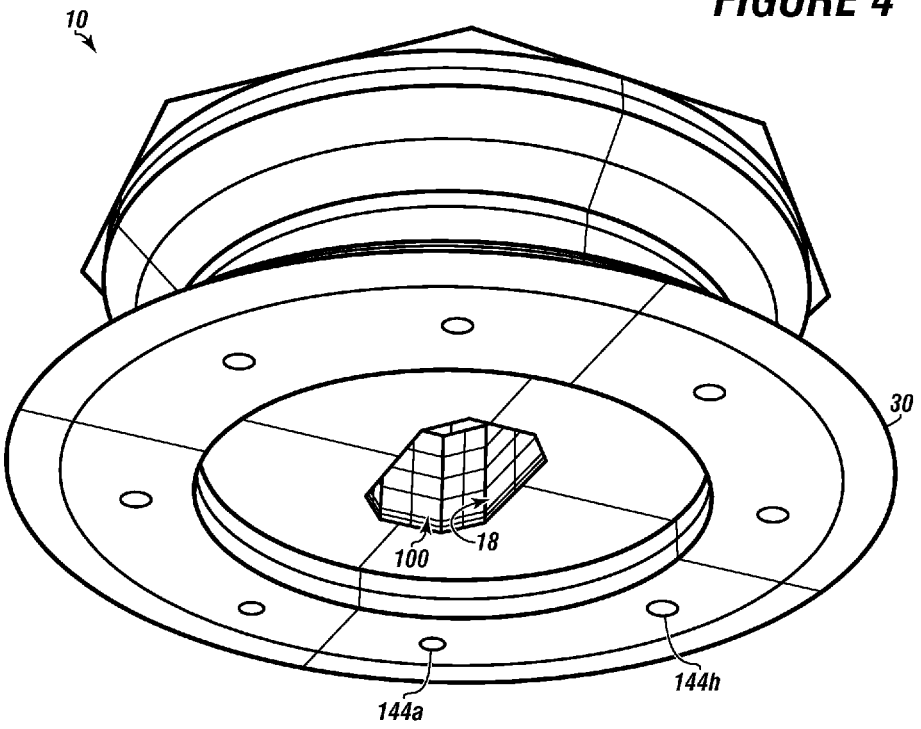
FIG. 4 depicts the buoyant structure with a planar keel having the moon pool according to one or more embodiments.

FIG. 4 depicts the buoyant structure 10 with the planar keel 30 having the moon pool 100 formed by the inner hull side 18 according to one or more embodiments.

The planar keel 30 can contain station keeping devices 144*a*-144*h*, which can be installed on the planar keel. In embodiments, the station keeping devices 144*a*-144*h* can be thrusters, jets, propellers or mooring lines. The thruster, jets and propellers can be in communication with the control center for dynamic station keeping. The mooring lines can also be in communication with the control center for verifying tensions on the mooring lines.

In embodiments, the planar keel 30 can integrally connect with the lower frustoconical portion.

FIG. 5 depicts the buoyant structure 10 with a plurality of columns 136*a*-136*d* according to one or more embodiments.

Each column can be mounted between the main deck and the planar keel. The columns can be connected to the outer hull side 16.

FIG. 6 depicts the buoyant structure 10 with a plurality of blister tanks 132*a*-132*d* according to one or more embodiments.

Each blister tank can be mounted between the main deck and the planar keel on the outer hull side 16.

FIG. 7 depicts the buoyant structure 10 with a hull neck 80 according to one or more embodiments.

The hull neck can be perpendicular to the planar keel. The neck can have a diameter that is between the main deck diameter and the keel diameter.

Each of the plurality of columns can be a different shape and dimension from the plurality of blister tanks, and a different shape and dimension from the at least one tendering arm.

In embodiments, each of the plurality of blister tanks can be a different shape and dimension from the plurality of columns and the at least one tendering arm.

In other embodiments, the at least one tendering arm can have a different shape and dimension from the plurality of columns and the plurality of blister tanks.

In embodiments, at least one of the plurality of columns, at least one of the plurality of blister tanks, and at least one tendering arm can be partly attached to the outer hull side.

While these embodiments have been described with emphasis on the embodiments, it should be understood that within the scope of the appended claims, the embodiments might be practiced other than as specifically described herein.

What is claimed is:

1. A buoyant structure for at least one of: petroleum drilling, hydrocarbon production, hydrocarbon storage, and hydrocarbon offloading, wherein the buoyant structure comprises:

a. a hull defining a vertical axis;

(i) an outer hull side;

(ii) an inner hull side;

(iii) a lower frustoconical portion with an inwardly sloping wall, the inwardly sloping wall formed at a first angle to a planar keel, the first angle ranging from 25 degrees to 85 degrees with respect to a plane of the planar keel; and (iv) an upper frustoconical portion with an outwardly sloping wall, the outwardly sloping wall sloping at a second angle ranging from 3 degrees to 85 degrees with respect to a plane of the planar keel with the upper frustoconical section abutting to the lower frustoconical section;

b. the planar keel defining a keel diameter, the keel diameter extending from 50 meters to 150 meters, the planar keel integrally connected with the lower frustoconical portion as a terminus of the inward sloping wall the planar keel formed between the outer hull side and inner hull side;

c. at least one external tank radially secured outboard of the hull in the upper frustoconical portion, the at least one external tank in communication with a control center contained by the hull;

d. a plurality of ballast compartments secured inboard of the hull, the plurality of ballast compartments in communication with the control center for ballasting and deballasting the hull between an operational position, a transit position and a lightship position;

e. a main deck having a concentric shape or a polygonal shape, the main deck connected over the upper frustoconical portion, the main deck partially formed between the outer hull side and the inner hull side; and f. a moon pool formed by the inner hull side, the moon pool characterized by at least one shape selected from the group: circular, polygonal, quadrilateral, ellipsoid, and geodesic; and wherein the combination of the upper frustoconical portion and the lower frustoconical portion provides an inherent stability to the buoyant structure by providing viscous damping that is both linear and quadratic damping resulting in minimum excitations of the buoyant structure in view of a global wave spectra.

2. The buoyant structure of claim 1, wherein the moon pool opens through the planar keel.

3. The buoyant structure of claim 1, comprising at least one of:

a. a plurality of columns, each column of the plurality of columns is mounted between the main deck and the planar keel;

b. a plurality of blister tanks, each blister tank of the plurality of blister tanks is mounted between the main deck and the planar keel; and c. at least one tendering arm mounted between the main deck and the planar keel.

4. The buoyant structure of claim 3, wherein the plurality of columns each comprise a different shape and dimension from the plurality of blister tanks and the at least one tendering arm.

5. The buoyant structure of claim 3, wherein the plurality of blister tanks each comprise a different shape and dimension from the plurality of columns and the at least one tendering arm.

6. The buoyant structure of claim 3, wherein the at least one tendering arm comprises a different shape and dimension from the plurality of columns and the plurality of blister tanks.

7. The buoyant structure of claim 3, wherein at least one of: at least one of the plurality of columns, at least one of the plurality of blister tanks, and the at least one tendering arm is partly attached to the outer hull side.

8. The buoyant structure of claim 1, wherein the main deck which has self-contained emergency equipment.

9. The buoyant structure of claim 1, further comprising a hull neck connected integrally between the upper frustoconical section and the lower frustoconical section.

10. The buoyant structure of claim 1, further comprising station keeping devices installed on the planar keel in communication with the control center.

11. The buoyant structure of claim 1, wherein the control center is in wired or wireless communication with devices the control center commands.

* * * * *